US005360050A

United States Patent [19]

Miyajima

[11] Patent Number: 5,360,050

[45] Date of Patent: Nov. 1, 1994

[54] METHOD OF PREPARING DISAPPEARING MODEL

[75] Inventor: Hidenobu Miyajima, Shizuoka, Japan

[73] Assignee: Asahi Tec Corporation, Shizuoka, Japan

[21] Appl. No.: 217,216

[22] Filed: Mar. 24, 1994

Related U.S. Application Data

[63] Continuation of Ser. No. 858,849, Mar. 27, 1992, abandoned.

[30] Foreign Application Priority Data

| | | | |
|---|---|---|---|
| Mar. 29, 1991 | [JP] | Japan | 3-067224 |
| Jul. 11, 1991 | [JP] | Japan | 3-171449 |
| Nov. 26, 1991 | [JP] | Japan | 3-311095 |

[51] Int. Cl.[5] ..... B22C 7/02; B22C 9/04; B22D 19/00

[52] U.S. Cl. ..... 164/45; 164/34; 164/98; 264/45.4; 264/221; 264/317

[58] Field of Search ..... 164/34, 35, 36, 45, 164/98; 264/221, 317, 45.4, 46.4, 46.9

[56] References Cited

U.S. PATENT DOCUMENTS

| | | | |
|---|---|---|---|
| 2,517,902 | 8/1950 | Luebkeman . | |
| 3,410,942 | 11/1968 | Bayer | 164/34 X |
| 3,432,582 | 3/1969 | Bender | 264/46.9 |
| 4,712,605 | 12/1987 | Sasaki et al. | 164/45 X |
| 4,743,481 | 5/1988 | Quinlan et al. | 264/221 X |
| 4,808,360 | 2/1989 | Natori et al. | 164/36 X |
| 4,812,278 | 3/1989 | Natori et al. | 164/36 X |
| 4,860,815 | 8/1989 | Parker et al. | 164/45 X |

FOREIGN PATENT DOCUMENTS

| | | | |
|---|---|---|---|
| 0305653 | 3/1989 | European Pat. Off. . | |
| 2109779 | 9/1972 | Germany | 164/45 |
| 52-11125 | 1/1977 | Japan | 164/34 |
| 53-37107 | 10/1978 | Japan | 264/46.9 |
| 59-89897 | 5/1984 | Japan | 264/45.4 |
| 61-286039 | 12/1986 | Japan | 164/65 |
| 63-230250 | 9/1988 | Japan | 164/45 |
| 64-78653 | 3/1989 | Japan | 164/35 |
| 1480324 | 7/1977 | United Kingdom | 264/46.9 |

OTHER PUBLICATIONS

WPIL Database, Derwent Publications, Lonbdon, GB, 86-276485/42 Abstract of JP 61-202827.

Patent Abstracts of Japan, vol. 9, No. 300 (M-433)(2033) Nov. 27, 1985 of JP 60-137545.

Patent Abstracts of Japan, vol. 8, No. 189 (M-321)(1626) Aug. 30, 1984 of JP 59-78749.

*Primary Examiner*—J. Reed Batten, Jr.

*Attorney, Agent, or Firm*—Sughrue, Mion, Zinn, Macpeak & Seas

[57] ABSTRACT

A film-like molded body having a hollow portion of a predetermined contour and made from a disappearing material is formed first using a mold. Also, a disappearing model is prepared by dividing it into a plurality of disappearing model elements. Then, the disappearing model elements are placed so as to enclose the film-like molded body with the film-like molded body as a core and are bonded together and fixed using an adhesive. Accordingly, the disappearing model can be prepared easily while preventing the adhesive from being forced out into the disappearing model and dispensing with extraction of the film-like molded body.

10 Claims, 8 Drawing Sheets

METHOD OF PREPARING DISAPPEARING MODEL

This is a continuation of application Ser. No. 07/858,849 filed Mar. 27, 1992 and now abandoned.

BACKGROUND OF THE INVENTION

The invention relates to a method of preparing a disappearing model, and more particularly, to a method in which when the disappearing model of a complicated contour is prepared by dividing it into a plurality of disappearing model elements and bonding and fixing afterwards, the forcing out of an adhesive toward the inside of the elements can be prevented.

The invention further relates to a composite molding method using a metal and a synthetic resin and to a molding produced thereby. More particularly, it is directed to a method which allows a disappearing model to be prepared easily by utilizing a casting method with the disappearing model.

The invention still further relates to a method of preparing a disappearing model, and more particularly, to a method which allows a disappearing model having a complicated shape to be prepared easily without dividing it.

There is a casting method which involves the use of a disappearing model. The disappearing model is made, e.g., from a foam styrol and has the same contour as a product to be cast. Such a disappearing model is placed inside a molding box and is enclosed by molding sand, so that molten metal can be poured into the enclosed disappearing model. Accordingly, such disappearing model becomes fused and has disappeared to allow the molten metal to be poured into the lost portion. As a result, a product having the same shape as the disappearing model can be produced.

The following problems have been addressed when the thus constructed conventional disappearing model is to be fabricated. For example, let us consider a disappearing model 101 having a simple shape such as shogun in FIGS. 14 and 15. This model has a hollow portion 103 extending straight, and by using a slide core of a metal mold or the like, the disappearing model 101 having such hollow portion 103 can be prepared easily.

In contrast thereto, a disappearing model 105 such as shown in FIGS. 16 and 17, a hollow portion 107, having steps, cannot be produced using the simple method with the slide core of a metal mold or the like. Employed to overcome this problem is a method in which the disappearing model 105 is prepared in two pieces and the two are bonded together with an adhesive.

However, a key to this method using the adhesive is the amount of the adhesive to be used. For example, too large an amount of adhesive may sometimes cause the adhesive to be forced out of the bonding surfaces. A portion of the adhesive forced outside the disappearing model can be chipped off, however a portion of the adhesive pressed inside the disappearing model cannot be taken away easily, thus causing defects when a product is obtained while cast with such forced-out adhesive unremoved. Further, too few adhesive results in forming a gap between the bonding surfaces, causing graver product defects.

A method of preparing a disappearing model using a molded body made from sand such as shell or cold box process is also available. This method will be described with reference to FIGS. 18 through 26. As shown in FIG. 18, a molded body 109 made from sand such as a shell or cold box process shown in FIG. 19 is molded using a box 111 for forming the molded body. Then, as shown in FIGS. 20 and 21, both a disappearing model 119 made from a foam resin and the molded body 109 are integrated using a disappearing model 115 and the molded body 109 (see FIG. 21).

Then, as shown in FIG. 22, a runner with pouring gate 121 is bonded and fixed onto the body integrating the disappearing model 119 and the molded body 109. And as shown in FIG. 23, not only a facing by coating 123 is applied, but also the body with the facing by coating 123 is placed inside a molding box 127 that is filled with molding sand 125. Thereafter, molten metal is poured into the body enclosed by the molding sand to prepare a molding 129 shown in FIG. 25. Then, not only the runner with pouring gate 121 and a like portion which are unnecessary are removed, but also the molded body 109 is removed, so that a molding 131 such as shown in FIG. 26 can be obtained.

The method using the molded body 109 entails destruction of the molded body 109. Also, the specific weight of the molded body 109, being 1.4 to 1.6, is heavier than that of the disappearing model 119 (the specific weight of the disappearing model 119 is 0.020 to 0.025), thus imposing the problem that the molded body 109 is hard to handle and that the handling cost is high. Specifically, part of the disappearing model becomes broken. Further, as shown in FIG. 23, in the process of applying the facing by coating 123, the molded body 109 absorbs the moisture of such facing 123. As a result, it takes time to remove the moisture of such facing 123, and if the casting process is proceeded without satisfactorily removing the moistrue of such facing 123, grave casting defects are caused.

A method of fabricating a molded product such as an intake manifold includes casting if it is made from metal such as aluminum, and die forming if made from a synthetic resin. In casting, a method using a so-called disappearing model is available. More specifically, the disappearing model that is modeled upon the contour of a product is prepared and placed in sand, and molten model is then poured into the model. As a result, part of the disappearing model disappears with the molten metal introduced into the lost part, so that a product having a predetermined contour can be cast. Also, in die forming, an injection molding is available.

The following problems have been addressed with the above-mentioned conventional construction. For example, let us think about a case in which an intake manifold 401 such as shown in FIG. 27 was fabricated according to the conventional method. When made from metal such as aluminum, the advantages are that the molded product is strong and that thick portions 403 can be molded by the casting method with a disappearing model. However, the disadvantages are that it is hearty and that it is hard to prepare a thin portion 405 by the casting method using the disappearing model. The reason is that if the thin portion 405 is molded by preparing a foam molded body, surrounding the foam molded body with sand, and poring molten metal into the foam molded body, then the heat of the molten metal is dissipated into the sand, with the molten metal being solidified so quickly that casting defects are caused.

On the other hand, when the intake manifold is made from a synthetic resin, the advantages are that the product is light and that the thin portion 405 can be molded easily, but the disadvantages is that it is not so strong, with an additional problem of having to use expensive molds.

SUMMARY OF THE INVENTION

The invention has been made in view of the above circumstances. Accordingly, an object of the invention is to provide a method of preparing a disappearing model which can surely prevent an adhesive from being forced out inside the disappearing model and which can dispense with extraction of auxiliary mold members after bonding when the disappearing model is prepared by dividing it into a plurality of disappearing model elements and by integrating the divided elements together by bonding.

Another object of the invention is to provide a method of preparing a disappearing model in which the disappearing model having a complicated contour can be prepared easily without dividing it.

Still another object of the invention is to provide not only a method of molding a product which is light and very strong and which includes a thick and a thin portion, but also such a molded product.

To achieve the above objects, a first aspect of the invention is applied to a method of preparing a disappearing model, which comprises the steps of: forming a film-like molded body not only having a hollow portion of a predetermined contour but also being made from a disappearing material; preparing the disappearing model by dividing it into a plurality of disappearing model elements; bonding by combining the plurality of disappearing model elements using an adhesive. At the time of bonding, the film-like molded body is placed so as to be enclosed by the combined disappearing model elements, so that the plurality of disappearing model elements can be bonded and fixed by the adhesive with the film-like molded body as a core.

Further, the above method includes that when the plurality of disappearing model elements are bonded and fixed by the adhesive with the film-like molded body as a core, a fluid is supplied into the film-like molded body to thereby prevent deformation of the film-like molded body.

The film-like molded body having a hollow portion of a predetermined contour and made from a disappearing material is prepared using a forming mold. Further, the disappearing model is prepared by dividing it into a plurality of disappearing model elements. The film-like molded body serves as a core for the disappearing model, while the disappearing model elements enclose the core. Both are bonded together to form a single disappearing model.

To bond and fix the plurality of disappearing model elements using the adhesive, the film-like molded body, serving as the core, is placed so as to be surrounded by the disappearing model elements. Accordingly, the disappearing model can be prepared while preventing the adhesive from being pressed out inside the disappearing model and dispensing with extraction of the film-like molded body.

Further, when the plurality of disappearing model elements are bonded and fixed with the film-like molded body as the core, a fluid is supplied into the film-like molded body to prevent deformation of the film-like molded body. What is required is only to supply a fluid in a simple manner, and the fluid may be taken away only after the casting has been completed. Thus, the film-like molded body can be handled with ease.

To achieve the above objects, a second aspect of the invention is applied to a method of preparing a disappearing model, which comprises the steps of: forming a film-like molded body both having a hollow portion of a predetermined contour and being made from a disappearing material; placing the molded body inside a foam mold having a hollow portion of a predetermined contour; filling foam beads between the hollow portion of the foam mold and the molded body to foam the beads and thus prepare a disappearing model having a hollow portion of a predetermined contour. It is preferable that deformation of the molded body be prevented by supplying a fluid having a predetermined pressure into the molded body when the foam beads are loaded between the hollow portion of the foam mold and the molded body to foam the foam beads.

The film-like molded body having a hollow portion of a predetermined contour and made from a disappearing material is formed using a molding machine. Then, the molded body is placed within a foam mold having a hollow portion of a predetermined contour, and foam beads are filled between the hollow portion of the foam mold and the molded body to then foam the foam beads, so that a disappearing model having a hollow portion of a predetermined contour can be prepared. In this case, the disappearing model is prepared by bonding the foamed resin portion with the molded body. Accordingly, by using the molded body made from a disappearing material, even a disappearing model having a complicated contour can be prepared easily without dividing it into a plurality of elements. Further, if a fluid having a predetermined pressure is supplied into the molded body when the foam beads are loaded between the hollow portion of the foam forming mold and the molded body and then foamed, it is effective in preparing the disappearing model having a predetermined contour while preventing deformation of the molded body.

To achieve the above objects, a third aspect of the invention is applied to a composite molding method using a metal and a synthetic resin, which method comprises the steps of: molding a film-like molded body made from a synthetic resin material; forming a disappearing model by integrating a foam molded body with the film-like molded body so as to enclose the film-like molded body; placing the disappearing model in sand and pouring molten metal into the disappearing model. Accordingly, a metal substituting the foam molded body and the film-like molded body portion that has not yet disappeared are integrated together by fusion to produce a composite molding.

Further, the composite molding made from a metal and a synthetic resin of the invention consists of a film-like molded body made from a synthetic resin material having a predetermined contour and a metal forming a predetermined contour while integrated by fusion with the film-like molded body so as to enclose the film-like molded body.

According to the composite molding method with a metal and a synthetic resin of the invention, the film-like molded body made from a synthetic resin material is molded first. Then, a disappearing model is prepared by integrating a foam molded body with the film-like molded body so as to enclose the film-like molded body. Thereafter, the disappearing model is surrounded by sand and molten metal is poured into the disappearing model to obtain a cast product. The molten metal causes the foam molded body to disappear and thereby allow the molten metal to be introduced into the foam molded body that has disappeared. Fused with the film-like molded body, a composite molding made from the metal and the synthetic resin can be produced. Also, a composite molding made from a metal and a synthectic resin of the invention is formed by the above-mentioned method.

DETAILED DESCRIPTION OF THE PREFERRED EMBODIMENTS

Figure 1:
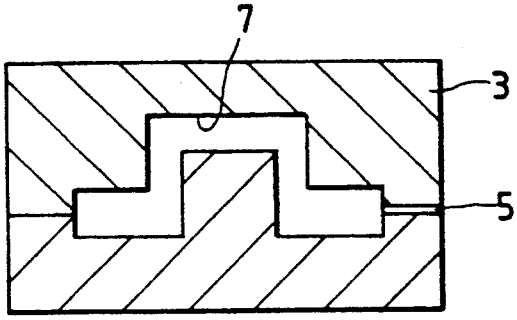
FIG. 1 is a sectional view showing a mold for preparing a molded body of a first embodiment of the invention.
Figure 2:
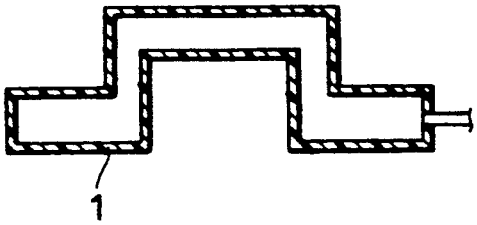
FIG. 2 is a sectional view showing the molded body of the first embodiment of the invention.
Figure 3:
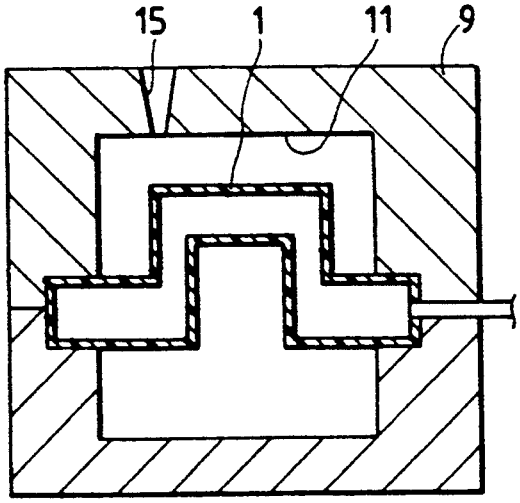
FIG. 3 is a sectional view showing a state of preparing a disappearing model by a foam molding machine of the first embodiment of the present invention.

A first embodiment of the invention will now be described with reference to FIGS. 1 through 10. A molded body 1 for preparing a disappearing model (see FIG. 2) is formed first. This molded body 1 is made from a disappearing material (e.g., polyethylene, polypropylene, etc.), and is hollow. In forming the molded body 1, the disappearing material is introduced into a blow mold 3 serving as a box for forming the molded body shown in FIG. 1 and air or the like is blown through a blowing gate 5. Inside the blow mold 3 is a hollow portion 7 of a predetermined shape, and the disappearing material is formed in thin film form into the shape of the hollow portion 7. The inner surface of the molded body 1 is formed into a predetermined shape that is the shape of the inner surface of a molding.

Then, the molded body 1 is taken out of the blow mold 3. Using the molded body 1 that has been taken out, and using a foam mold 9 shown in FIG. 3, a disappearing model is fabricated. The foam mold 9 has a hollow portion 11 of a predetermined shape. The molded body 1 is placed within this hollow portion 11. At this point, reinforcing members (not shown) are used to reinforce the molded body 1 if necessary. The reinforcing members are also made from the disappearing material as the molded body 1.

Figure 4:
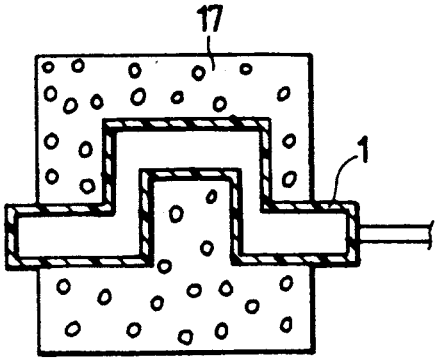
FIGS. 4 and 5 are sectional views showing the prepared disappearing model of the first embodiment of the invention.

Then, foam beads are filled into the hollow portion 11 through a blowing gate 15, and the foam beads are foamed by blowing 1.2 kg/cm$^2$ of vapor at 120° C. to thereby prepare a disappearing model 17 (see FIG. 4). At this point, to regulate deformation of the molded body 1, a fluid such as water, air, oil, etc. is supplied into the molded body 1 in such a manner as to match the pressure of the vapor, e.g., at a pressure of about 1.2 kg/cm$^2$. A single disappearing model 17 is thus prepared with the foam resin portion being bonded onto the molded body 1.

Figure 6:
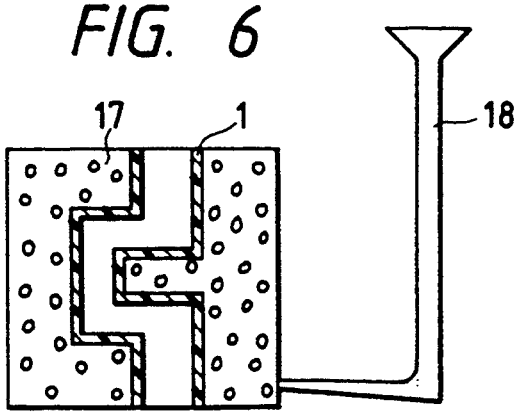
FIG. 6 is a sectional view of showing a state in which a runner with pouring gate is bonded and fixed onto the disappearing model of the first embodiment of the invention.
Figure 5:
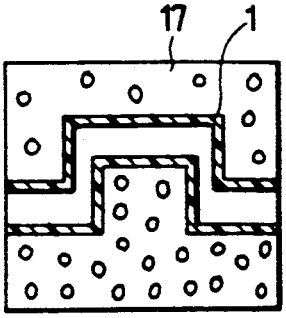
Figure 7:
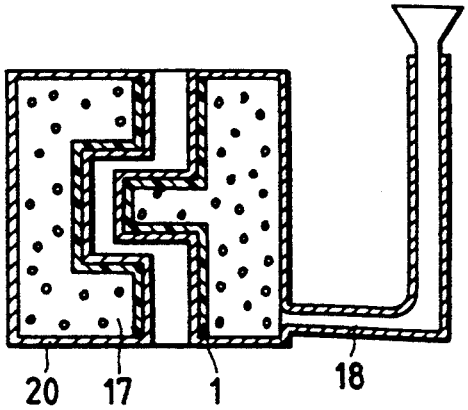
FIG. 7 is a sectional view showing a state, in which a facing by coating is applied, of the first embodiment of the invention.
Figure 8:
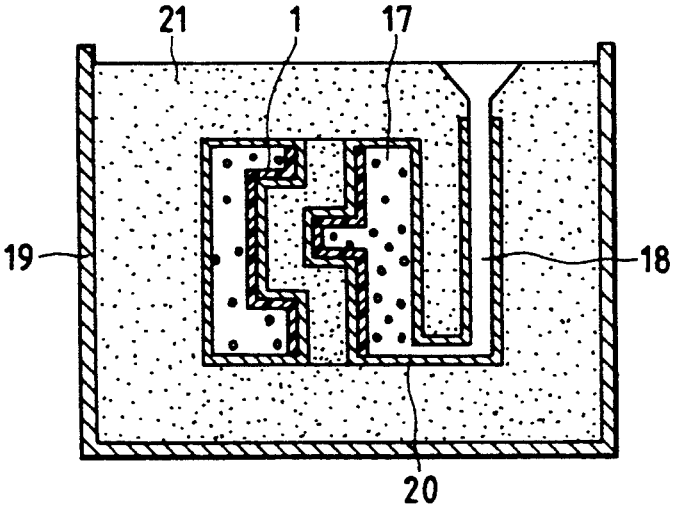
FIG. 8 is a sectional view showing a casting process of the first embodiment of the invention.
Figure 9:
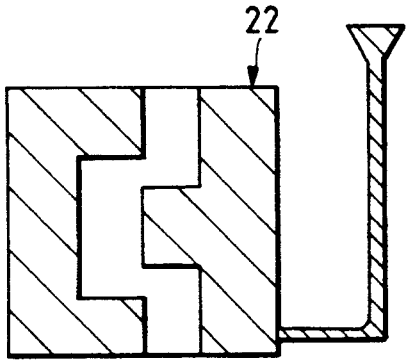
FIGS. 9 and 10 sectional views showing a casting of the first embodiment of the present invention.
Figure 10:
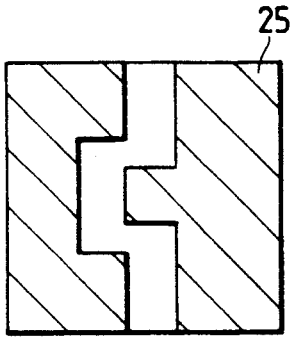

Once the disappearing model 17 has been fabricated, it is taken out of the foam mold 9, and any protrusions of the molded body 1 are removed as shown in FIG. 4 to bring the molded body 1 to be in a state shown in FIG. 5. Then, as shown in FIG. 6, a runner with pouring gate 18 is bonded and fixed. As shown in FIG. 7, a facing by coating 20 is applied onto the surfaces of the disappearing model 17 and the runner 18. Then, as shown in FIG. 8, the molded body 1 thus formed is placed inside a mold 19 to be cast with molding sand 21 loaded thereto. That is, as molten metal is poured through the runner with pouring gate 18, the disappearing model 17 is gradually melted and disappears, allowing the molten metal to be introduced into such portion that has disappeared. As a result, a casting 22 shown in FIG. 9 can be prepared. With unnecessary portions such as the runner with pouring gate 18 and the like removed afterwards, a product 25 such as shown in FIG. 10 can finally be obtained.

According to the first embodiment, the following advantages can be obtained. Even a disappearing model 17 having a complicated shape can be fabricated easily without dividing it. The reason is that the molded body 1 made from a disappearing material is used and that such molded body 1 may be formed into a predetermined shape. This dispenses with the use of an adhesive, which has been the source of apprehension in the conventional method involving division of the disappearing model. Thus, the problem of having defects in the products can be eliminated with the method of the invention. The method of the invention having the particular feature of being free from the problem of forcing some adhesive out will allow an exhaust manifold, an intake manifold, etc. of an engine to be produced satisfactorily.

Unlike the conventional molded body made from sand such as shell or cold box process, the molded body 1 is hollow and light so that it can be handled with ease. Particularly, it is not necessary to take it out after the disappearing model 17 has been prepared, thus contributing to achieving remarkable simplification of the molding process. Since its material is inexpensive, a cost reduction can also be implemented.

With respect to the fabricated disappearing model 17, like an ordinary disappearing model, the facing by coating 20 can be applied to its surfaces, thereby allowing the inner and outer surfaces to be smooth.

Figure 11:
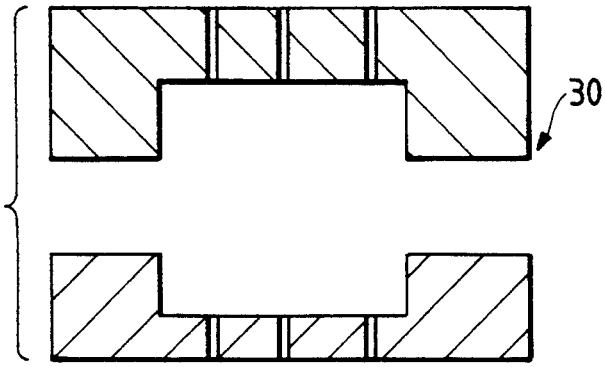
FIG. 11 is a sectional view showing a mold for preparing a molded body of a second embodiment of the present invention.
Figure 12:
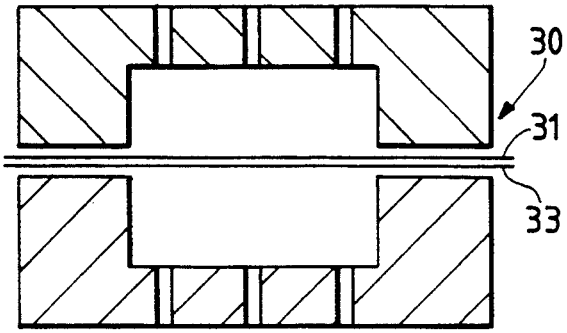
FIGS. 12 and 13 are sectional views showing the molded body being prepared of the second embodiment of the present invention.
Figure 13:
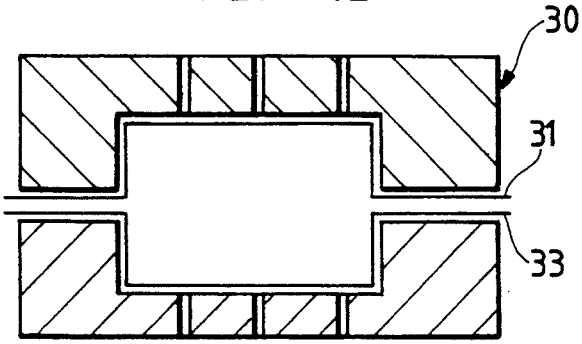
Figure 14:
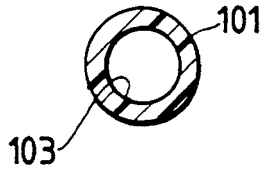
FIG. 14 PRIOR ART
FIGS. 14 and 16 are front views showing conventional disappearing models, respectively.
Figure 15:
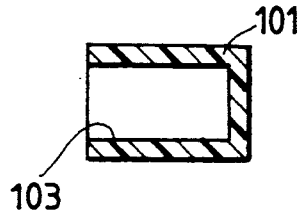
FIG. 15 PRIOR ART
FIGS. 15 and 17 are sectional views showing the conventional disappearing models, respectively.
Figure 16:
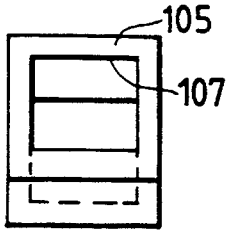
FIG. 16 PRIOR ART
Figure 17:
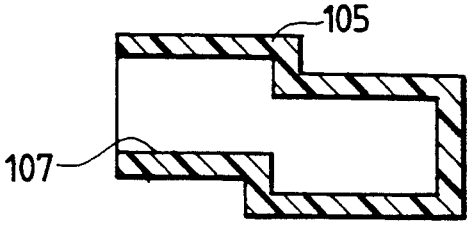
FIG. 17 PRIOR ART
Figure 18:
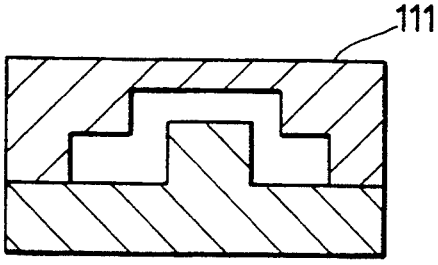
FIG. 18 PRIOR ART
FIG. 18 is a sectional view showing a conventional mold for preparing a conventional molded body.
Figure 19:
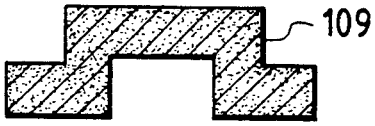
FIG. 19 PRIOR ART
FIG. 19 is a sectional view showing the conventional molded body.
Figure 20:
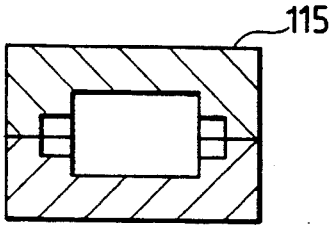
FIG. 20 PRIOR ART
FIG. 20 is a sectional view of a conventional mold for preparing the conventional disappearing model.
Figure 21:
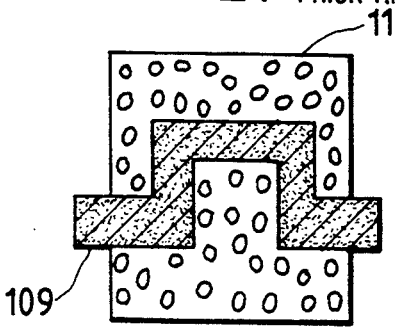
FIG. 21 PRIOR ART
FIG. 21 is a sectional view showing the conventional disappearing model.
Figure 22:
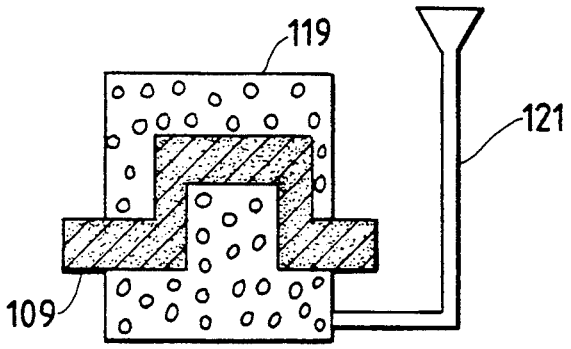
FIG. 22 PRIOR ART
FIG. 22 is a sectional view showing a state in which a runner with pouring gate is bonded and fixed onto the conventional disappearing model.
Figure 23:
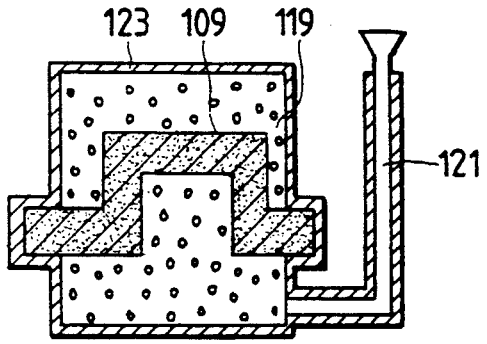
FIG. 23 PRIOR ART
FIG. 23 is a sectional view showing a state in which a facing by coating is applied on the conventional disappearing model.
Figure 24:
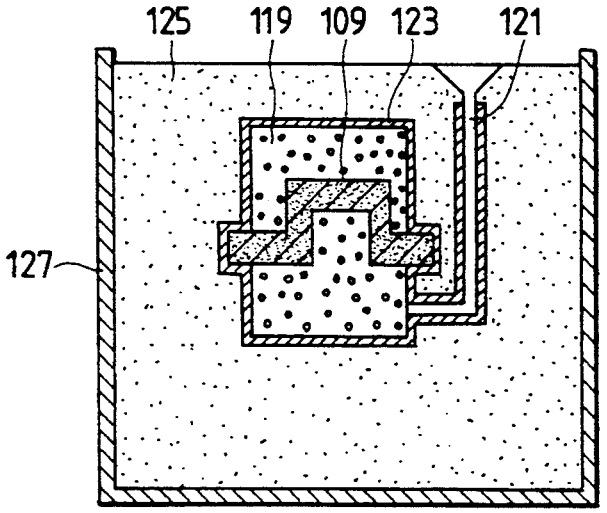
FIG. 24 PRIOR ART
FIG. 24 is a sectional view showing a conventional casting process.
Figure 25:
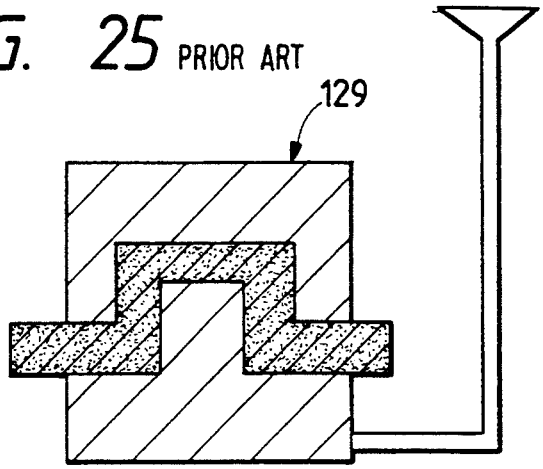
FIG. 25 PRIOR ART
FIGS. 25 and 26 are sectional views showing a conventional casting.
Figure 26:
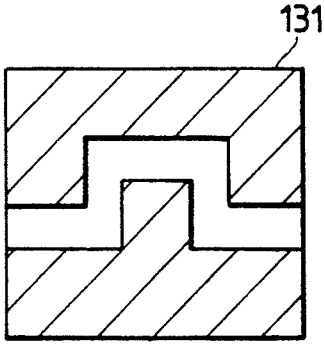
FIG. 26 PRIOR ART
Figure 27:
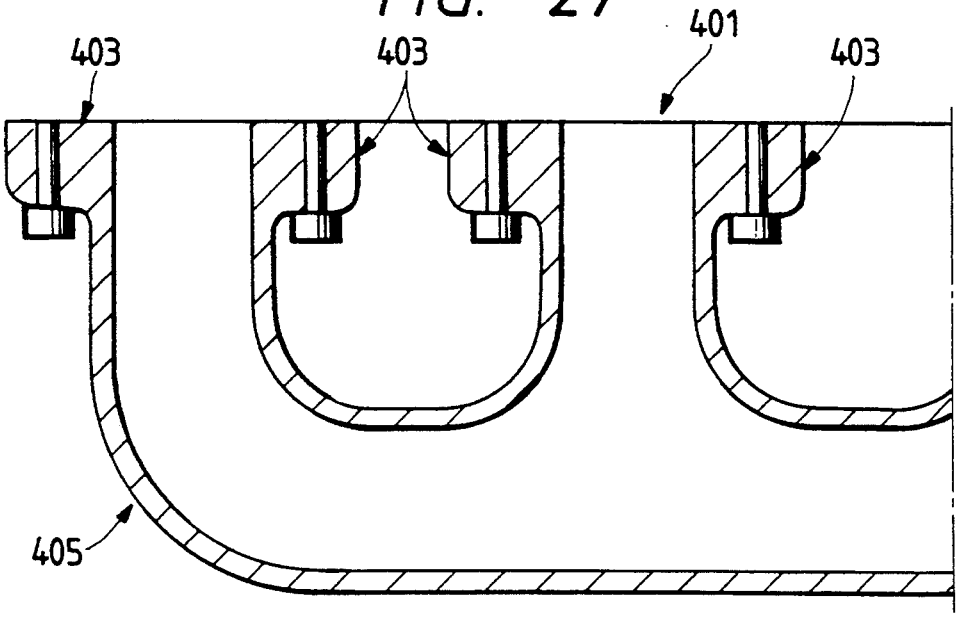
FIG. 27 PRIOR ART
FIG. 27 is a sectional view showing a part of an intake manifold formed by a conventional molding method.

A second embodiment of the invention will be described with reference to FIGS. 11 through 13. While the blow mold 3 is used as a mold for forming the molded body in the first embodiment, a vacuum mold 30 is used in this embodiment. That is, as shown in FIG. 12, films 31, 33 are placed in the mold 30 for forming a molded body. Under this condition, as shown in FIG. 13, the films 31, 33 are deformed by evacuation in such a manner as to be fitted with the shape of the hollow portion of the mold 30 to obtain a molded body 1.

The invention is not limited to the above embodiments. The thickness of the molded body 1 is not particularly limited. Also, whether the reinforcing members are employed or not depends on the thickness of the molded body 1. While the example in which a disappearing model having a complicated shape has been described in each of the above embodiments, the invention may, of course, be applied to the fabrication of a disappearing model having a simple contour. Further, the molded body may be produced using an injection molding machine, etc., other than with the blow molding machine or the vacuum molding machine.

As described above in detail, the method of preparing a disappearing model of the first and second embodiments of the present invention invention allows the disappearing model to be prepared using the hollow molded body made from a disappearing material, so that even a disappearing model having a complicated shape can be prepared easily without dividing it. As a result, the use of an adhesive can be dispensed with, which not only eliminates the problems associated with the use of the adhesive, but also provides such advantages as making the molded body light and inexpensive, as well as easy to handle, and eliminating the work of taking the molded body out.

A third embodiment of the invention will be described with reference to FIGS. 28 and 29. A disappearing model 201 consists of a film-like molded body 203 serving as a core and disappearing model elements 205, 207 enclosing the film-like molded body 203. The disappearing elements are in two pieces, fabricated as two separate prefabricated elements.

The film-like molded body 203 is first formed to prepare the disappearing model 201. The film-like molded body 203 is made from a disappearing material (e.g., polyethylene, polypropylene, etc.) and is hollow. In molding the film-like molded body 203, the film-like disappearing material is placed within a blow mold, and air or the like is blown into the hollow portion through a blowing gate. Inside the blow mold is the hollow portion having a predetermined shape. As a result, the disappearing material is molded into a thin film extending along with the shape of the hollow portion. The inner surface of the film-like molded body 203 is formed into a predetermined shape of the inner surface of a produced casting.

Further, the disappearing model elements 205, 207 are molded by loading foam beads into a foam mold and foaming the foam beads while blowing vapor into the mold.

These disappearing model elements 205, 207 are bonded and fixed by an adhesive 209. To bond them together, the film-like molded body 203 is placed inside the disappearing model elements 205, 207. Further, clamping auxiliary molds 211, 213 are placed on the outer surface of the disappearing model elements 205, 207.

Figure 28:
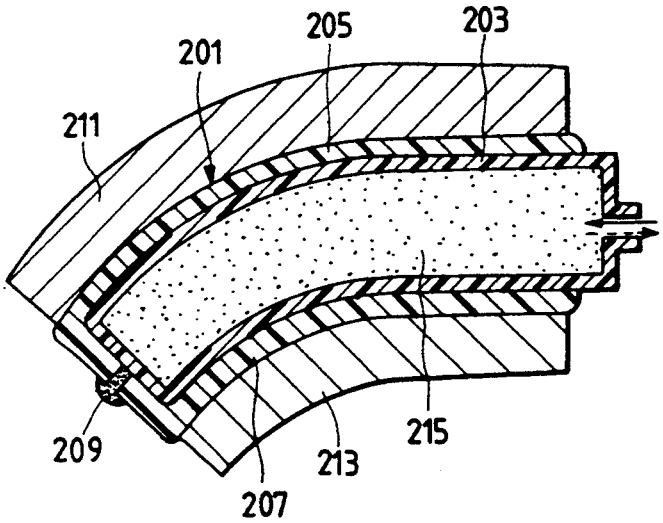
FIG. 28 is longitudinal sectional view showing a disappearing model of a third embodiment of the invention.
Figure 29:
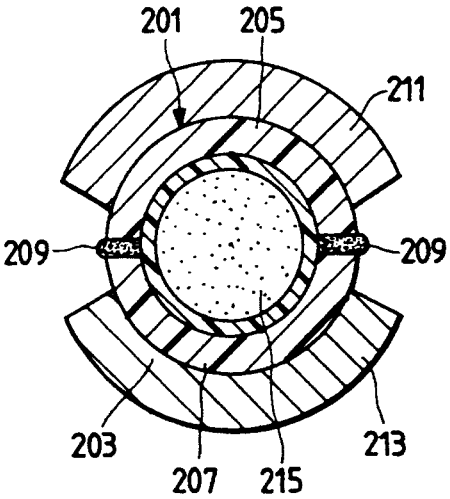
FIG. 29 is a horizontal sectional view showing a method of preparing a disappearing model of third embodiment of the present invention.

The film-like molded body 203 is hollow, and when bonding the disappearing mold elements 205, 207 together, a fluid 215 such as sand is supplied as shown by a solid arrow in FIG. 28 into the hollow portion of the film-like molded body 203 to prevent the film-like molded body from being deformed and to bring it into intimate contact with the inner surfaces of the disappearing model elements 205, 207. By applying pressure to the clamping auxiliary molds 211, 213 to near the disappearing model elements 205, 207 under this condition, the disappearing model elements 205, 207 are bonded and fixed with the adhesive 209. After the adhesion and fixing of the disappearing model elements 205, 207, the fluid 215 in the hollow portion of the film-like molded body 203 is removed as shown by a broken arrow in FIG. 28. Accordingly, the film-like molded body 203 and the disappearing model elements 205, 207 are bonded together to be integrated, completing the disappearing model 201.

The following advantages can be obtained according to the third embodiment of the invention. First, when the disappearing model elements 205, 207 are bonded and fixed with the adhesive 209, the forcing out of the adhesive 209 inside the disappearing model elements 205, 207 can be prevented. The reason is that the disappearing model elements 205, 207 are bonded to the outside the film-like molded body 203 which serves as a core. Accordingly, the disappearing model 201 having a smooth inner surface can be obtained, with an additional advantage of improved molding quality. Particularly, the absence of the problem of forcing the adhesive out inside the disappearing model, this method is suitably applicable to exhaust manifolds or intake manifolds, etc. The adhesive 209 that has been forced outside the disappearing model may be scraped off before molding or after molding.

Further, since the disappearing model elements 205, 207 are bonded with the film-like molded body 203 as a core, there is no need for extracting it after bonding as in the case of using the reinforcing auxiliary members, thus simplifying the molding work.

Still further, since the film-like molded body 203 and the disappearing model elements 205, 207 are integrated by bonding, there is no need for heating as in the case of foam molding, thereby obviating deformation and transformation of the film-like molded body 203.

The invention is not limited to the above embodiment. The number of division of the disappearing model 201 can be arbitrarily selected. Further, the material to be supplied into the hollow portion to prevent deformation of the film-like molded body is not limited to sand, but various means may be employed.

As described above in detail, the method of preparing a disappearing model of the invention not only prevents the adhesive from being forced out inside the disappearing model when bonding and fixing a plurality of divided disappearing model elements together, but also dispenses with the work of extracting the auxiliary mold members, thereby making the molding process simple.

A fourth embodiment of the invention will be described with reference to FIGS. 30 through 34. This embodiment involves the process of preparing an intake manifold 301 shown in FIG. 34 by a method of the invention. The intake manifold 301 has such a shape characterized by an extending single passage 303 whose section is substantially cylindrical and by a plurality of passages 305 that are branched out from the passage 303. The thicknesses of the passages 303, 305 are thin so that the intake manifold 301 is light as a whole. The end portion of each branched passage 305 has a bolt mounting seat 307. This portion is thick, so as to have strength.

Figure 30:
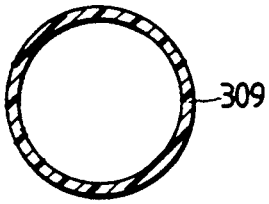
FIG. 30 is a sectional view showing a film-like molded body of a fourth embodiment of the present invention.
Figure 31:
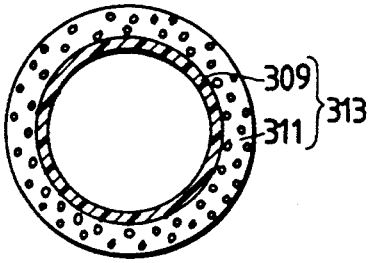
FIG. 31 is a sectional view showing a disappearing model of the fourth embodiment of the present invention.

The method of the invention will hereunder be described with reference to a sectional view of the branched passages 305. As shown in FIG. 30, a film-like molded body 309 having a predetermined shape is made from a synthetic resin. For example, blow molding is employed using a synthetic resin such as polypropylene or polyethylene. In this case, the inner shape of the film-like molded body 309 is made to coincide with the shape of each passage 305 of the manifold 301, and its thickness is set to an arbitrary value which is smaller than that of a molding.

Then, a disappearing model 313 is formed by integrating a foam molded body 311 around the film-like molded body 309. This is done, e.g., by insert molding. In this case, the film-like molded body 309 is placed inside the upper and lower foam molds, with such upper and lower molds being abutted against each other to form a hollow portion, and foam beads are loaded into the hollow portion. Vapor is then blown into the hollow portion to foam the foam beads and thereby mold the disappearing model 313 with the film-like molded body 309 and the foam molded body 311 being integrated with each other. The thickness of the foam molded body 311 is set to such a value in advance that the disappearing model 313 has a predetermined shape and thickness of each passage 305 of the intake manifold 301 while taking the thickness of the film-like molded body 309 into consideration.

Figure 32:
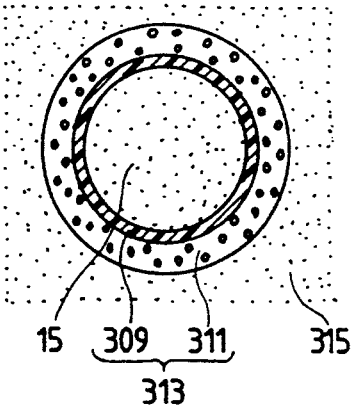
FIG. 32 is a sectional view showing a state, in which the disappearing model is covered with sand, of the fourth embodiment of the present invention.
Figure 33:
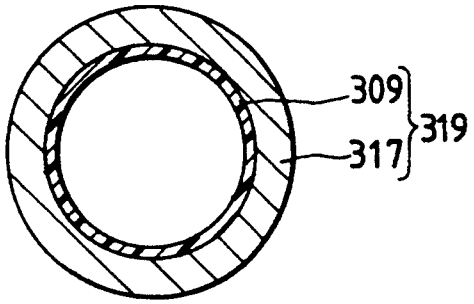
FIG. 33 is a sectional view showing a composite molding of the fourth embodiment of the present invention.
Figure 34:
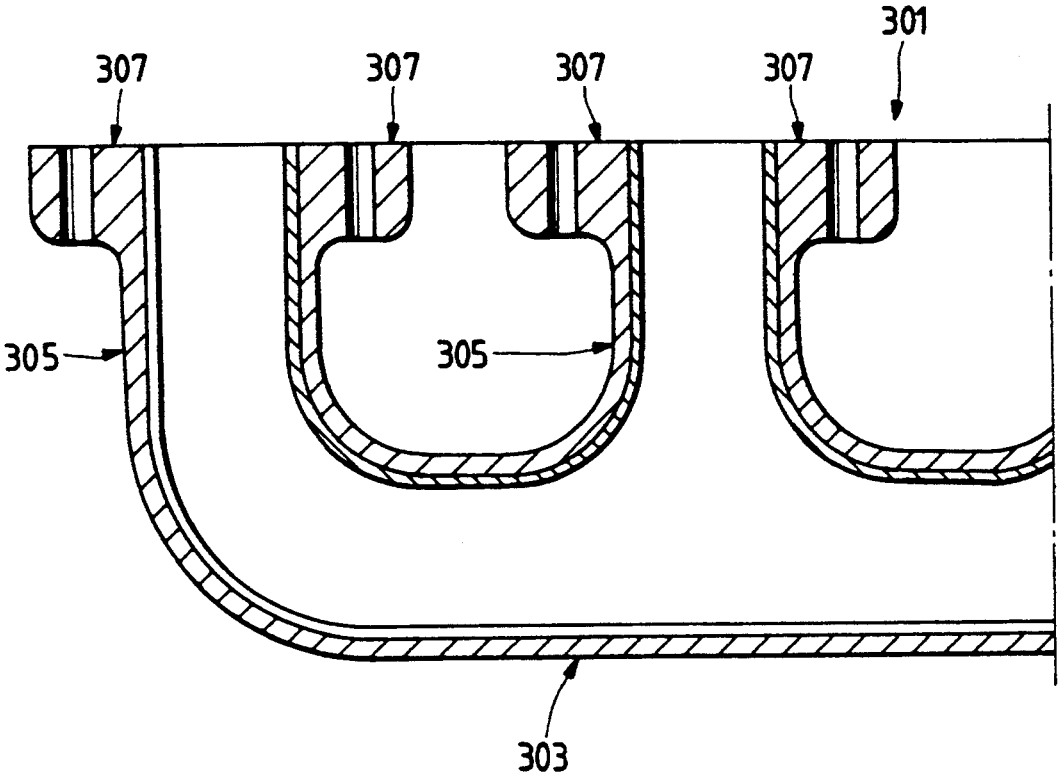
FIG. 34 is a sectional view showing a part of an intake manifold of the fourth embodiment of the present invention.

As shown in FIG. 32, by covering the periphery of the disappearing model 313 with sand 315, molten metal (aluminum) is poured into the disappearing model 313. This method is the same as the conventional casting with a disappearing model and involves the steps of: mounting a runner onto the disappearing model 313; applying a facing agent; placing the disappearing model 303 with the facing agent within a molding box; and loading the sand into the molding box. Then, by pouring the molten metal through the runner, a portion of the foam molded body 311 out of the disappearing model 313 disappears, allowing the molten metal to substitute for the portion that has disappeared. On the other hand, the film-like molded body 309 portion does not disappear, and as a result, as shown in FIG. 33, a composite molding 310 is obtained. The outer periphery of the product is made from a metal 317 and the inner periphery is the film-like molded body 319 which remains as it is and which, where it comes in immediate contact with the molten metal, is fused with the molten metal to be integrated therewith.

In this case, the thick portions (the mounting sheets 307 of the intake manifold 301) are formed by making the foam molded body 311 thick, so that the molten metal is poured extensively to form the thick portions made from the metal 317. Further, it has conventionally been difficult to fabricate the thin portion (the passage 303 of the intake manifold 301) by casting with a disappearing model. However, in the invention, the surface of the disappearing model 313 is enclosed by the film-like molded body 309. Generally, the heat conductivity of sand is in the order of 2.0 kcal/mhdeg, while that of a synthetic resin (polypropylene) is in the order of 0.00756 kcal/mhdeg. Thus, the disappearing model 313 has a structure from which heat is hard to escape. As a result, if the molten metal is poured by covering the outer surface of the disappearing model 313 with sand, heat is not transmitted nearly as quickly to the film-like molded body 309 made from a highly heat-insulating synthetic resin material, and the amount of heat transmitted to the sand 315 out of the heat of the molten metal is substantially halved compared with a case in which both inner and outer surfaces are covered with sand. This retards solidification of the molten metal, thus allowing the molten metal to be extended well into the thin portion so that such portion can be molded well.

By chipping off unnecessary parts from the composite molded product 319 thereafter, a final product can be obtained. In the inside of the product remains the film-like molded body 309 as it is while unmelted by the heat, with its inner surface forming the predetermined shape of each passage 305 of the intake manifold 301. Further, the outside is made from the metal (aluminum) 317, the outside surface is formed into the predetermined shape that is the outer contour of the intake manifold 301. The film-like molded body 309 and the metal 317 are fused into complete integration by heat of the molten metal.

The following advantages can be obtained according to the fourth embodiment of the invention. First, a novel molded product integrated by composite molding with the synthetic resin and the metal can be obtained. This molding has good features of both the metal and the synthetic resin. Specifically, a light and strong product can be obtained, its lightness being derived from the synthetic resin and its strength from the metal.

Further, the molding method according to this embodiment is suitably applied to an intake manifold having both a thin and a thick portion. More specifically, the thin portion is cast using a disappearing model formed by combining the film-like molded body with the foam molded body. This allows the heat of the molten metal transmitted to the sand to be reduced by half, so that a thin metal wall can be formed, and the thin portion can be made strong. The thick portion can also be given sufficient strength by thickening not only the foam molded body but also the metallic portion.

Still further, according to this embodiment, no expensive molds such as used in syntectic resin molding is required, which allows a method similar to casting using a disappearing model to be employed, with an additional advantage of easy fabrication.

The invention is not limited to the above embodiments. For example, to integrate the film-like molded body with the foam molded body, the foam molded body may be molded by division and such foam molded body may be integrated with the film-like molded body. As a metal, not only aluminum but also iron or the like may be used. As a film-like molded body, heat-resistant resins may also be used. Further, the positional relationship between the film-like molded body and the foam molded body can arbitrarily be selected.

As described in the foregoing pages, according to the composite molding method using a metal and a synthetic resin, as well as a product molded thereby of the invention, the film-like molded body made from a synthetic resin is combined with a metal to form a molded product having a predetermined shape. Therefore, a light and highly strong molded product can be fabricated. Further, the fabrication is easy and inexpensive, and the method can be applied to products having thin portions as well.

What is claimed is:

1. A method of preparing a disappearing model, comprising the steps of:

forming a hollow film-like molded body in a mold, said film-like molded body including an inner portion being substantially the same shape of a hollow portion of a predetermined contour, said film-like molded body being able to retain its shape without additional support;

preparing a disappearing foam model around said film-like molded body; and applying a facing agent to the entire exposed surface of said disappearing model.

2. A method of preparing a disappearing foam model as claimed in claim 1, said disappearing foam model is divided into a plurality of disappearing model elements.

3. A method of preparing a disappearing model as claimed in claim 2, wherein said disappearing foam model elements are disposed around the outer surface of said film-like molded body, so that said film-like molded body serves as a core when said plurality of disappearing foam model elements are bonded and fixed together into clamping auxiliary molds with an adhesive.

4. A method of preparing a disappearing model as claimed in claim 3, wherein a fluid is supplied into said film-like molded body with a predetermined pressure to prevent deformation of said film-like molded body when said plurality of disappearing foam model elements are bonded and fixed together with said adhesive.

5. A method of preparing a disappearing model as claimed in claim 1, wherein said film-like molded body is made of a disappearing material.

6. A method of preparing a disappearing model as claimed in claim 1, wherein said preparing step includes the steps comprising:

placing said film-like molded body inside a mold used to produce a foam product, said mold having a hollow portion of said predetermined contour;

filling foam beads between said hollow portion of said mold used to produce a foam product and said film-like molded body; and foaming said beads to prepare said disappearing foam model having a hollow portion of said predetermined contour.

7. A method of preparing a disappearing model as claimed in claim 6, wherein a fluid is supplied into said film-like molded body with a predetermined pressure when said disappearing model is prepared.

8. A method of forming a composite product comprising a metal and a synthetic resin material, said method comprising the steps of:

forming a film-like molded body made from a synthetic resin material, said film-like molded body being substantially the same shape as a hollow portion of a predetermined contour;

forming a disappearing model by integrating a foam molded body around said film-like molded body;

applying a facing agent to the entire exposed surface of said disappearing model;

placing said disappearing model in a sand mold; and pouring molten metal into said disappearing model to prepare said composite product.

9. A method of forming a composite product as claimed in claim 8, wherein said film-like molded body includes a hollow portion, said hollow portion of said film-like molded body being substantially the same shape of said hollow portion of said predetermined contour.

10. A method of forming a composite product as claimed in claim 8, wherein said step of forming the disappearing model comprises placing said film-like molded body inside upper and lower molds used to produce a foam product, and loading foam beads between said molds and said film-like molded body.

* * * * *